US007910526B2

(12) United States Patent
Kakizaki et al.

(10) Patent No.: US 7,910,526 B2
(45) Date of Patent: Mar. 22, 2011

(54) GREASE COMPOSITION FOR CONSTANT VELOCITY JOINT AND CONSTANT VELOCITY JOINT CONTAINING THE COMPOSITION SEALED THEREIN

(75) Inventors: Mitsuhiro Kakizaki, Fujisawa (JP); Takashi Okaniwa, Fujisawa (JP); Minoru Ishijima, Iwata (JP); Shinichi Takabe, Iwata (JP)

(73) Assignees: Kyodo Yushi Co., Ltd., Tokyo (JP); NTN Corporation, Osaka (JP)

( * ) Notice: Subject to any disclaimer, the term of this patent is extended or adjusted under 35 U.S.C. 154(b) by 1095 days.

(21) Appl. No.: 11/642,742

(22) Filed: Dec. 21, 2006

(65) Prior Publication Data

US 2007/0099801 A1 May 3, 2007

Related U.S. Application Data

(63) Continuation of application No. PCT/JP2005/012192, filed on Jul. 1, 2005.

(30) Foreign Application Priority Data

Jul. 1, 2004 (JP) ..... 2004-195340

(51) Int. Cl.

| | |
|---|---|
| ***C10M 169/06*** | (2006.01) |
| ***C10M 125/22*** | (2006.01) |
| ***C10M 159/22*** | (2006.01) |
| ***C10M 133/20*** | (2006.01) |

(52) U.S. Cl. ..... 508/168; 508/166; 508/363; 508/586; 508/552

(58) Field of Classification Search ..... 508/166, 508/168, 363, 586, 552

See application file for complete search history.

(56) References Cited

U.S. PATENT DOCUMENTS

| | | | | |
|---|---|---|---|---|
| 5,607,906 | A | 3/1997 | Okaniwa et al. | |
| 6,022,835 | A * | 2/2000 | Fletcher | 508/365 |
| 6,037,314 | A | 3/2000 | Kondo et al. | |
| 6,355,602 | B1 | 3/2002 | Okaniwa et al. | |
| 6,432,889 | B1 * | 8/2002 | Kinoshita et al. | 508/399 |

FOREIGN PATENT DOCUMENTS

| | | |
|---|---|---|
| EP | 0 811 675 | 12/1997 |
| JP | 09-194871 | 7/1997 |
| JP | 09-324189 | 12/1997 |
| JP | 09-324190 | 12/1997 |
| JP | 10-273692 | 10/1998 |
| JP | 2001-011482 | 1/2001 |
| JP | 2002-038177 | 2/2002 |
| JP | 2003-165988 | 6/2003 |
| JP | 2004-123858 | 4/2004 |

* cited by examiner

*Primary Examiner* — Glenn Caldarola
*Assistant Examiner* — Jim Goloboy
(74) *Attorney, Agent, or Firm* — Nixon & Vanderhye P.C.

(57) ABSTRACT

The present invention provides a grease composition for use in constant velocity joints, which comprises the following components (a) to (g) and a constant velocity joint comprising the grease composition sealed or encapsulated therein:

(a) a base oil;

(b) a diurea thickener represented by the following general formula:

$$R^1NH—CO—NH—C_6H_4\text{-}p\text{-}CH_2—C_6H_4\text{-}p\text{-}NH—CO—NHR^2$$

wherein $R^1$ and $R^2$ each independently represents an alkyl group having 8 to 20 carbon atoms, an aryl group having 6 to 12 carbon atoms or a cycloalkyl group having 6 to 12 carbon atoms;

(c) a molybdenum dialkyl dithiocarbamate insoluble in the base oil;

(d) a molybdenum dialkyl dithiocarbamate soluble in the base oil;

(e) molybdenum disulfide;

(f) at least one member selected from the group consisting of calcium phenate and calcium sulfonate; and (g) a sulfur-containing extreme-pressure agent free of phosphorus.

The grease composition can efficiently prevent a temperature rise of a constant velocity joint and can impart excellent durability to the joint.

6 Claims, No Drawings

GREASE COMPOSITION FOR CONSTANT VELOCITY JOINT AND CONSTANT VELOCITY JOINT CONTAINING THE COMPOSITION SEALED THEREIN

This application is a U.S. continuation application of international application PCT/JP2005/012192 filed 1 Jul. 2005, which designated the U.S. and claims benefit of JP 2004-195340, filed 1 Jul. 2004, the entire contents of each of which are hereby incorporated by reference.

TECHNICAL FIELD

The present invention relates to a grease composition for constant velocity joints and in particular, to a grease composition for constant velocity joints, suitably used in a fixed-type or slide-type constant velocity joint for automobiles. The present invention also relates to a constant velocity joint containing the grease composition sealed therein.

BACKGROUND ART

At present, in the field of the automobile industries, the number of the front engine-front drive (FF) type automobiles produced has rapidly been increased in order to reduce the weight thereof to a level as low as possible and to ensure a larger housing space within the automobile. In addition, the number of the four wheel drive (4WD) vehicles recently produced has likewise rapidly been increased from the viewpoint of their functionality. In these FF-type and 4WD-type automobiles, the power-transmission and the steering thereof are performed through the front wheels and therefore, the power should smoothly be transmitted to the automobiles even when the driver, for instance, fully manipulate the handle thereof. For this reason, these FF-type and 4WD-type automobiles should be equipped with a constant velocity joint as an essential part for transmitting rotational motions at a constant velocity even when the angle between two shafts which cross each other is variously changed.

Moreover, as the constant velocity joint, there have conventionally been used fixed type constant velocity joints such as Zeppa type ones. In such a Zeppa type one, when the joint transmits a turning force while it takes a working or operating angle, it may generate complicated rolling and sliding motions between the component parts thereof interfitted together. Thus, the fixed type constant velocity joint such as a Zeppa type one must withstand severer lubricating conditions from the viewpoints of, for instance, the gradual increase in the output of engines, the ability of automobiles to run at a higher speed and the reduction of the weight of the constant velocity joint, although it has been required for the fixed type constant velocity joints of this type to undergo more complicated motions. As a result, further problems additionally arise, such that the constant velocity joint should further be improved not only in its durability (flaking life), but also the ability of controlling heat generation during using the same.

Similarly, in case of the sliding type constant velocity joint (such as double-offset type constant velocity joint: DOJ) which has such an ability to absorb any change in the effective length of the drive shaft accompanied by the vertical motions of wheels through the sliding motions (10 to 100 mm) of the balls packaged within the joint in the direction of its expansion, it has been required for such a joint to be improved in the durability (flaking life) and the ability of controlling heat generation.

Conventionally, there have been known, for instance, grease compositions for use in constant velocity joints (see, for instance, Patent Document 1 specified below), each comprising a base oil, a specific diurea thickener, molybdenum dialkyl dithiocarbamate, molybdenum disulfide, a specific sulfur-containing extreme-pressure agent and a sulfur and nitrogen-containing extreme-pressure agent. In addition, there have also been known grease products for use in constant velocity joints (see, for instance, Patent Document 2 specified below), each comprising a base grease prepared by incorporating a thickener to a base oil; and a molybdenum dithiocarbamate soluble in the foregoing base oil as well as a molybdenum dithiocarbamate insoluble in the foregoing base oil.

However, these conventional grease compositions suffer from such a problem that the use thereof is insufficient for effective control of heat generation during using the same, while keeping their excellent durability.

Patent Document 1: JP-A-10-273692 (In particular, Claim 1);

Patent Document 2: JP-A-2003-165988 (In particular, Claim 1).

DISCLOSURE OF THE INVENTION

Problems to be Solved by the Invention

It is, accordingly, an object of the present invention to provide a grease composition for use in constant velocity joints, which can ensure the satisfied durability of the constant velocity joint containing the same, while effectively suppressing a temperature rise in the constant velocity joint during its operation.

Means for Solving the Problems

The inventors of this invention have conducted various studies to accomplish the foregoing object of the present invention, have found that the foregoing problems associated with conventional grease compositions can efficiently be eliminated by incorporating, into a base oil, a combination of a specific diurea thickener, two kinds of specific organic molybdenum compounds, molybdenum disulfide, calcium phenate or calcium sulfonate and a specific extreme-pressure agent, and have thus completed the present invention on the basis of such a finding.

More specifically, the present invention herein provides the following grease composition for use in constant velocity joints as well as a constant velocity joint containing the grease composition incorporated and sealed therein:

1. A grease composition for use in constant velocity joints, comprising the following components (a) to (g):
   (a) abase oil;
   (b) a diurea thickener represented by the following general formula:

$$R^1NH—CO—NH—C_6H_4\text{-p-}CH_2—C_6H_4\text{-p-}NH—CO—NHR^2$$

wherein $R^1$ and $R^2$ each independently represents an alkyl group having 8 to 20 carbon atoms, an aryl group having 6 to 12 carbon atoms or a cycloalkyl group having 6 to 12 carbon atoms;

(c) a molybdenum dialkyl dithiocarbamate insoluble in the base oil;
   (d) a molybdenum dialkyl dithiocarbamate soluble in the base oil;
   (e) molybdenum disulfide;
   (f) at least one member selected from the group consisting of calcium phenate and calcium sulfonate; and (g) a sulfur-containing extreme-pressure agent free of phosphorus.

2. The grease composition for use in constant velocity joints as set forth in the foregoing item 1, wherein the content of the component (b) ranges from 1 to 20% by mass, that of the component (c) ranges from 0.1 to 10% by mass, that of the component (d) ranges from 0.1 to 10% by mass, that of the component (e) ranges from 0.1 to 10% by mass, that of the component (f) ranges from 0.1 to 10% by mass, and that of the component (g) ranges from 0.1 to 10% by mass, on the basis of the total mass of the grease composition.
3. The grease composition for use in constant velocity joints as set forth in the foregoing item 1 or 2, wherein the constant velocity joint is a fixed type one.
4. The grease composition for use in constant velocity joints as set forth in the foregoing item 1 or 2, wherein the constant velocity joint is a sliding type one.
5. A constant velocity joint comprising a grease composition as set forth in any one of the foregoing items 1 to 4, sealed therein.

Effects Of The Invention

The grease composition for use in constant velocity joints according to the present invention can efficiently suppress a temperature rise in a constant velocity joint to which the composition is applied and can impart excellent durability to the constant velocity joint containing the same. In addition, the present invention also provides a constant velocity joint which comprises a grease composition, incorporated and sealed therein, having such excellent quality.

BEST MODE FOR CARRYING OUT THE INVENTION

The grease composition for constant velocity joints according to the present invention means a grease-like composition for use in constant velocity joints. The term "constant velocity joint" herein used means a part for transmitting rotational motions at a constant velocity even when the angle between two shafts which cross each other is variously changed. Moreover, the term "grease" herein used means a solid or semi-solid product comprising a base oil and a thickener dispersed therein.

The grease composition for constant velocity joints according to the present invention is characterized in that it comprises the foregoing components (a) to (g) as essential ingredients. These components will separately be described in more detail below.

First of all, examples of base oils usable herein as the component (a) include mineral oils such as naphthenic oils, paraffinic oils, liquid paraffin and hydrogenated and dewaxed oils. More specifically, examples of base oils usable herein as the component (a) include ester-containing synthetic oils represented by diesters and polyol esters; synthetic hydrocarbon oils represented by poly(α-olefins), and polybutene; ether-containing synthetic oils represented by alkyl diphenyl ethers and polypropylene glycol; silicone oils; and fluorinated oils. In the present invention, mineral oils and synthetic oils may be used alone or in any combination thereof, as the base oil or as the component (a). Particularly preferably used herein are mineral oils which are used alone. The content of the base oil as the component (a) in the grease composition may be the balance of the composition, on the basis of the total mass of the composition and more specifically, the content thereof corresponds to the total mass of the composition from which sum of the amounts of the components (including optional components) other than the base oil is subtracted and it may fall, for instance, within the range of from 30.0 to 98.5% by mass and preferably 81 to 87% by mass, but the present invention is not restricted to such a specific range at all.

The diurea thickener used in the grease composition of the present invention as the component (b) is one represented by the following general formula:

$$R^1NH—CO—NH—C_6H_4\text{-p-}CH_2—C_6H_4\text{-p-}NH—CO—NHR^2$$

wherein $R^1$ and $R^2$ may be the same or different and each represents an alkyl group having 8 to 20, preferably 8 to 18 carbon atoms, an aryl group having 6 to 12, preferably 6 to 7 carbon-atoms or a cycloalkyl group having 6 to 12, preferably 6 to 7 carbon atoms.

The diurea thickener used as the component (b) may be, for instance, prepared through the reaction of a desired diisocyanate with a desired monoamine. The diisocyanate is more specifically diphenylmethane-4,4'-diisocyanate. The monoamine may be, for instance, aliphatic amines, aromatic amines, alicyclic amines and mixtures thereof. Specific examples of such aliphatic amines are octylamine, dodecylamine, hexadecylamine, octadecylamine and oleylamine. Specific examples of such aromatic amines are aniline and p-toluidine. Specific examples of such alicyclic amines include cyclohexylamine.

Preferably used herein are diurea thickeners obtained by the use of octylamine, dodecylamine, hexadecylamine, octadecylamine or a mixture thereof among others, as the component (b).

The content of the diurea thickener as the component (b) on the basis of the total mass of the composition may vary depending on the kind of each particular one. A penetration of the grease composition of the present invention suitably falls within the range specified later and therefore, the content of the diurea thickener as the component (b) is preferably one required for imparting such a desired penetration to the grease composition. More specifically, the content of the component (b), on the basis of the total mass of the composition, ranges from, for instance, 1 to 25% by mass and preferably 2 to 20% by mass, but the present invention is not restricted to such a specific range.

In respect of the foregoing molybdenum dialkyl dithiocarbamate insoluble in the base oil (hereafter simply referred to as "oil-insoluble MoDTC") used as the component (c) in the present invention, the term "insoluble in the base oil (oil-insoluble properties)" used herein means that when the dialkyl dithiocarbamate is added to the base oil in a concentration of 0.5% by mass, followed by stirring thereof, maintenance of the resulting mixture at 70° C. for 24 hours and subsequent visual observation thereof, insolubles remain in the base oil. Preferably, the term means that 98% by mass of the added component (c) remain as insolubles. When insolubles remain in the base oil, the resulting mixture is not transparent, but is in a colloidal state or a suspension, which can be observed with naked eyes.

As the oil-insoluble MoDTC or the component (c), preferably used herein include those represented by the following general formula:

$$[R^3R^4N—CS—S]_2—Mo_2O_mS_n$$

wherein $R^3$ and $R^4$ each independently represents an alkyl group having, for instance, 1 to 4 and preferably 2 to 4 carbon atoms, m ranges from 0 to 3, n ranges from 4 to 1, and m+n=4.

The content of the oil-insoluble MoDTC or the component (c), on the basis of the total mass of the composition, falls within the range of, for instance, from 0.1 to 10% by mass and preferably 0.5 to 5% by mass.

In respect of the foregoing molybdenum dialkyl dithiocarbamate soluble in the base oil (hereafter simply referred to as "oil-soluble MoDTC") used as the component (d) in the present invention, the term "soluble in the base oil (oil-soluble properties)" used herein means that when the dialkyl dithiocarbamate is added to the base oil in a concentration of 0.5% by mass, followed by stirring thereof, maintenance of the resulting mixture at 70° C. for 24 hours and subsequent visual observation thereof, insolubles do not remain in the base oil. As the oil-soluble MoDTC or the component (d), preferably used herein include those represented by the following general formula:

$$[R^3R^4N—CS—S]_2—MO_2O_mS_n$$

wherein $R^3$ and R4 each represents an alkyl group having 5 to 24 and preferably 5 to 18 carbon atoms, m ranges from 0 to 3, n ranges from 4 to 1, and m+n=4.

The content of the oil-soluble MoDTC or the component (d), on the basis of the total mass of the composition, falls within the range of, for instance, from 0.1 to 10% by mass and preferably 0.5 to 5% by mass.

In this respect, a mixing ratio of the oil-insoluble MoDTC or the component (c) to the oil-soluble MoDTC or the component (d) preferably ranges from 5:95 to 95:5 and more preferably 20:80 to 40:60 as expressed in terms of the mass ratio.

The molybdenum disulfide used in the present invention as the component (e) is in general one which has widely been used as a solid lubricating agent in the constant velocity joint. It has been known that the lubricating mechanism thereof would be as follows: it has a lamellar lattice-like structure and it can easily shear in the form of a thin layer by the action of sliding motions to thus reduce the frictional resistance. Moreover, it is also effective to prevent seizure of the constant velocity joint.

The content of the molybdenum disulfide or the component (e), on the basis of the total mass of the composition, ranges, for instance, from 0.1 to 10% by mass and preferably 0.5 to 5% by mass. The added amount thereof should be limited to such a level that it does not adversely affect, for instance, frictional coefficient and vibrational characteristics.

The component (f) used in the present invention may be, for instance, calcium phenates such as calcium salts of alkyl phenol sulfides and those commercially available as detergent-dispersants may be used herein. Alternatively, the component (f) may be calcium sulfonates such as those known in the art. As the component (f), calcium phenates and calcium sulfonates may be used in combination in any mixing rate.

The content of the calcium phenate and/or calcium sulfonate or the component (X), on the basis of the total mass of the composition, ranges, for instance, from 0.1 to 10% by mass and preferably 0.5 to 5% by mass.

Examples of the sulfur-containing extreme-pressure agents free of phosphorus used in the present invention as the component (g) are those each having a sulfur content ranging from 5 to 30% by mass. For instance, the components (g) usable herein are zinc dithiocarbamates, for example, zinc dialkyl dithiocarbamates substituted with two alkyl groups.

The content of the component (g) relative to the total mass of the composition ranges, for instance, from 0.1 to 10% by mass and preferably 0.5 to 5% by mass.

Moreover, the grease composition for use in constant velocity joints according to the present invention may further include a variety of additives, if necessary. Examples of such optional additives include antioxidants, rust preventives, metal-corrosion inhibitors, oiliness improvers, wear-resistant agents, extreme-pressure agents and solid lubricating agents.

The grease composition for use in constant velocity joints according to the present invention may easily be prepared by the use of the foregoing components (a) to (g) as essential ingredients and the foregoing various kinds of additives as arbitrary components. A method for the preparation thereof comprises, for instance, the steps of mixing the component (a) and the component (b) to thus form an urea grease, in advance, serving as a base; and then incorporating the remaining components (c) to (g) into the base, appropriately.

The grease composition for use in constant velocity joints according to the present invention preferably has a penetration, as determined according to the method specified in, for instance, JIS K2220 5.3, ranging from 265 to 385 and more preferably 310 to 340. In this respect, the penetration of the grease composition may be controlled by the use of a desired amount of the foregoing component (b).

The grease composition for use in constant velocity joints according to the present invention may be applied to various kinds of constant velocity joints without any restriction, but it is preferably applied to the constant velocity joints provided with spherical torque-transmitting members and in particular, to fixed type constant velocity joints such as Zeppa type joints. Alternatively, the grease composition for use in constant velocity joints according to the present invention may likewise be applied to the slide-type constant velocity joints such as double offset type constant velocity joints (DOJ). Accordingly, a variety of constant velocity joints comprising the foregoing grease composition incorporated and sealed therein likewise fall within the scope of the present invention.

EXAMPLE 1

The present invention will hereafter be described in more detail with reference to the following Examples and Comparative Examples.

Preparation of Grease Compositions:

Diphenylmethane-4,4'-diisocyanate (250 g; 1 mole), octylamine (129 g; 1 mole) and octadecylamine (270 g; 1 mole) were reacted together in 4000 g of a mineral oil (a) (one having a kinetic viscosity as determined at 100° C. of 13.5 $mm^2/s$) and the resulting diurea-containing compound (b) was uniformly dispersed therein to give a base grease. To the resulting base grease, there were added additives specified in the following Table 1 or 2 in amounts likewise specified therein, and then the penetration of the mixture was controlled to a level on the order of JIS Penetration No. 1 Grade (310 to 340) in a three-stage roll mill, while appropriately introducing an additional amount of the mineral oil (a) into the resulting mixture.

TABLE 1

| | Example | | | |
|---|---|---|---|---|
| Component | 1 | 2 | 3 | 4 |
| (a) | 84.0 | 82.0 | 81.0 | 84.0 |
| (b) | 6.0 | 6.0 | 6.0 | 6.0 |
| (c)*1 | 2.0 | 2.0 | 2.0 | 2.0 |
| (d)*2 | 3.0 | 5.0 | 3.0 | 3.0 |
| (e)*3 | 2.0 | 2.0 | 2.0 | 2.0 |
| (f)*4 | 2.0 | 2.0 | 5.0 | 2.0 |
| (g)*5 | 1.0 | 1.0 | 1.0 | 1.0*5-1 |
| Total Amt. (% by mass) | 100 | | | |
| Penetration*6 | No. 1 | | | |
| Temp. rise-inhibitory characteristics*7 | ○ | ○ | ○ | ○ |
| Durability*8 | ○ | ○ | ○ | ○ |

TABLE 2

| Component | Comparative Example 1 | 2 | 3 | 4 | 5 |
|---|---|---|---|---|---|
| (a) | 86.0 | 87.0 | 86.0 | 86.0 | 85.0 |
| (b) | 6.0 | 6.0 | 6.0 | 6.0 | 6.0 |
| (c)*1 | — | 2.0 | 2.0 | 2.0 | 2.0 |
| (d)*2 | 3.0 | — | 3.0 | 3.0 | 3.0 |
| (e)*3 | 2.0 | 2.0 | — | 2.0 | 2.0 |
| (f)*4 | 2.0 | 2.0 | 2.0 | — | 2.0 |
| (g)*5 | 1.0 | 1.0 | 1.0 | 1.0 | — |
| Total Amt. (% by mass) | | | 100 | | |
| Penetration*6 | | | No. 1 | | |
| Temp. rise-inhibitory characteristics*7 | X | X | ○ | X | ○ |
| Durability*8 | X | ○ | X | ○ | X |

*1Oil-insoluble MoDTC ($[R^3R^4N—CS—S]_2—Mo_2O_mS_n$ wherein $R^3$ and $R^4$ each represents an alkyl group having 4 carbon atoms, m ranges from 0 to 3, n ranges from 4 to 1, and m + n = 4).

*2Oil-soluble MoDTC ($[R^3R^4N—CS—S]_2—Mo_2O_mS_n$ wherein $R^3$ and $R^4$ each represents an alkyl group having 13 carbon atoms, m ranges from 0 to 3, n ranges from 4 to 1, and m + n = 4).

*3Molybdenum disulfide (average particle size: 0.45 μm).

*4Calcium phenate (TBN = 144)

*5Sulfur-containing extreme-pressure agent free of phosphorus (Vulcanized oil: S = 10.5%).

*5-1: Sulfur-containing extreme-pressure agent free of phosphorus (ZnDTC: S = 12.3%).

*6determined according to the method specified in JIS K2220 5.3.

*7Method for the Evaluation of Temperature Rise-Inhibitory Characteristics:

The boot of a fixed type constant velocity joint (Zeppa type one) was filled with each of the grease compositions prepared in Examples 1 to 4 and
Comparative Examples 1 to 5 and the resulting joint was operated under the following conditions: a rotational number of 1500 rpm; a torque of 300 N · m; and at a joint angle of 10 deg.

Evaluation Criteria for Temperature Rise-Inhibitory Characteristics:

○: Good; the surface temperature of the outer ring is lower than 110° C.; and

X: Unacceptable; the surface temperature of the outer ring is higher than 110° C.

*8Method for the Evaluation of Durability:

The boot of a fixed type constant velocity joint (Zeppa type one) was filled with each of the grease compositions prepared in Examples 1 to 4 and
Comparative Examples 1 to 5 and the resulting joint was operated under the following conditions: a rotational number of 200 rpm; a torque of 1000 N · m; and at a joint angle of 10 deg.

Evaluation Criteria for Durability:

○: Good; continuous running is possible.

X: Unacceptable; continuous running is not possible.

Results:

The foregoing data clearly indicates that the grease composition for use in constant velocity joints prepared in Examples 1 to 4 according to the present invention can impart, to the constant velocity joints, considerably excellent temperature rise-inhibitory characteristics and durability, as compared with the products prepared in Comparative Examples 1 to 5.

INDUSTRIAL APPLICABILITY

The grease composition for use in constant velocity joints according to the present invention can efficiently prevent a temperature rise of a constant velocity joint and can impart excellent durability to the joint.

What is claimed is:

1. A grease composition for use in constant velocity joints, comprising the following components (a) to (g):

(a) a base oil;

(b) a diurea thickener represented by the following general formula:

$$R^1NH—CO—NH—C_6H_4\text{-p-}CH_2\text{-}C_6H_4\text{-p-}NH—CO—NHR^2$$

wherein $R^1$ and $R^2$ each independently represents an alkyl group having 8 to 20 carbon atoms, an aryl group having 6 to 12 carbon atoms or a cycloalkyl group having 6 to 12 carbon atoms;

(c) a molybdenum dialkyl dithiocarbamate insoluble in the base oil;

(d) a molybdenum dialkyl dithiocarbamate soluble in the base oil;

(e) molybdenum disulfide;

(f) calcium phenate; and (g) a sulfur-containing extreme-pressure agent free of phosphorus, wherein the content of the component (b) ranges from 2 to 20% by mass, that of the component (c) ranges from 0.5 to 5% by mass, that of the component (d) ranges from 0.5 to 5% by mass, that of the component (e) ranges from 0.5 to 5% by mass, that of the component (f) ranges from 0.5 to 5% by mass, and that of the component (g) ranges from 0.5 to 5% by mass, on the basis of the total mass of the grease composition, and wherein a mixing ratio of the oil-insoluble component (c) to the oil-soluble component (d) ranges from 20:80 to 40:60 as expressed in terms of the mass ratio.

2. The grease composition for use in constant velocity joints as set forth in claim 1, wherein the constant velocity joint is a fixed type one.

3. The grease composition for use in constant velocity joints as set forth in claim 1, wherein the constant velocity joint is a sliding type one.

4. A constant velocity joint comprising a grease composition as set forth in claim 1, sealed therein.

5. A constant velocity joint comprising a grease composition as set forth in claim 2, sealed therein.

6. A constant velocity joint comprising a grease composition as set forth in claim 3, sealed therein.

* * * * *